US005471925A

United States Patent [19]

Heinrich et al.

[11] Patent Number: 5,471,925

[45] Date of Patent: Dec. 5, 1995

[54] APPARATUS AND METHOD FOR CHANGING THE TEXT PORTION OF LOGOS FOR POSTAGE METERS

[75] Inventors: Klaus Heinrich, Selingenstadt; Thomas Epping, Hanau, both of Germany

[73] Assignee: Francotyn-Postalia GmbH, Berlin, Germany

[21] Appl. No.: 83,047

[22] Filed: Jun. 25, 1993

[30] Foreign Application Priority Data

Jun. 26, 1992 [DE] Germany ..... 42 21 270.7

[51] Int. Cl.[6] ..... G07B 17/02

[52] U.S. Cl. ..... 101/91; 364/464.02

[58] Field of Search ..... 101/91; 364/464.01, 364/464.02

[56] References Cited

U.S. PATENT DOCUMENTS

| | | | |
|---|---|---|---|
| 4,831,554 | 5/1989 | Storace et al. | 101/91 |
| 4,933,849 | 6/1990 | Connell et al. | 364/464.02 |
| 4,949,381 | 8/1990 | Pastor | 380/51 |
| 5,075,862 | 12/1991 | Doeberl et al. | 101/91 |
| 5,186,498 | 2/1993 | Dietrich | 283/67 |
| 5,233,657 | 8/1993 | Günther | 380/23 |

FOREIGN PATENT DOCUMENTS

| | | | |
|---|---|---|---|
| 0421491 | 4/1991 | European Pat. Off. | 101/91 |
| 0440021 | 8/1991 | European Pat. Off. | 101/91 |
| 0492439 | 7/1992 | European Pat. Off. | 101/91 |
| 3712100 | 10/1987 | Germany | 101/91 |
| 3823719 | 1/1989 | Germany | 400/91 |
| 3840041 | 6/1990 | Germany | 400/91 |
| 4003006 | 8/1991 | Germany | 400/91 |
| 4034292 | 4/1992 | Germany | 400/91 |
| 88/01818 | 3/1988 | WIPO | 400/91 |

*Primary Examiner*—Edgar S. Burr
*Assistant Examiner*—Steven S. Kelley
*Attorney, Agent, or Firm*—Herbert L. Lerner; Laurence A. Greenberg

[57] ABSTRACT

An apparatus for changing the text portion of logos for postage meters includes a printer module for a fully electronically produced postage meter imprint having an advertising logo, at least one input, a display unit, an input/output control module, a nonvolatile memory for at least unchanging parts of the postage meter imprint, a control device, and a printer control for producing a printed pattern having been formed by a microprocessor-controlled printing process immediately prior to printing of fixed data and current data and being available in buffer-stored form. A first memory region is provided for storing data for the unchanging parts of the postage meter imprint applying at least to a frame of an advertising logo, and an associated name identifying the logo frame. A second memory region is provided for storing data for variable parts of the postage meter imprint applying to at least one logo text portion, and an associated name identifying the logo text portion. A third memory region is provided for storing data for a first association of the names of the logo text portions with the names of the logo frames. A method for changing the text portion of logos for postage meters includes loading agreed-upon types of logos by modem or chip card, selecting a logo frame, editing a text portion of a logo in the postage meter, and composing and displaying a complete view of a postage meter imprint.

11 Claims, 2 Drawing Sheets

APPARATUS AND METHOD FOR CHANGING THE TEXT PORTION OF LOGOS FOR POSTAGE METERS

SPECIFICATION

Figure 1:
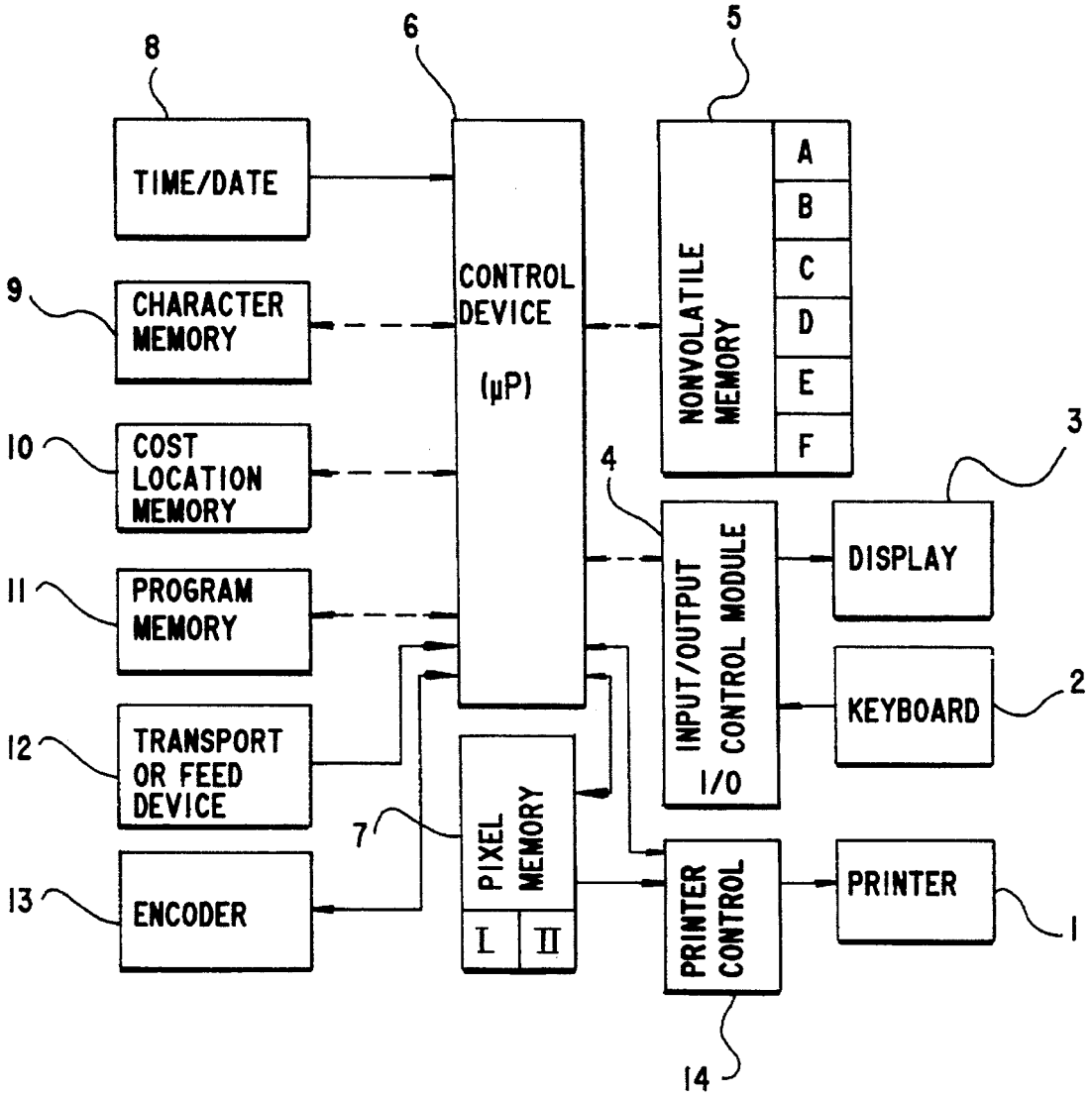

The invention relates to an apparatus and a method for changing the text portion of logos for postage meters or franking machines, which can be used for applying postage to mail including printing an advertising logo. The postage meter is equipped with at least one input means, output means, an input/output control module, a memory for at least one advertising logo, a control device, and a printer module. The method for changing the text portion of logos for postage meters includes the following steps:

a) loading agreed-upon types of a logo by modem or chip card;

b) selecting a type of logo;

c) editing a text portion of a logo in the postage meter; and d) composing a complete representation.

It is well known for an advertising message to be applied to a fixed printing stock, that cannot be altered by the user.

In a version described in German Published, Non-Prosecuted Application DE 38 40 041 A1, the imprints of the logo that do not continuously vary are applied to a printing drum, and the various parts of the logo (identifying data) are produced electronically and imprinted by a thermal printer. The identifying data are purely mechanically associated with a specific point in the logo.

For reasons of security if no other, German Published, Non-Prosecuted Application DE 40 34 292 A1, in the case of a fully electronically produced printed image, has proposed storing only an unchanging part of the postage meter imprint in memory in the postage meter, and sending the other associated variable portion from the data center of the postage meter, in order to compose the final printed image.

In that version, however, the advertising field is still among the unchanging data of the postage meter imprint, such as the frame configuration of the value being printed, with the place name and zip code. Although the problem of modifying advertising messages without lessening the security that the proper fee will be paid can be solved mechanically, nevertheless heretofore no fully electronically produced advertising logo has been partially modified in the postage meter.

Published European Application No. 0 294 397 discloses an automatic transfer system with microprocessor cards. The user cards are provided with a microprocessor and a data output unit. The postage meter has a terminal for the user card, with a value processing section, programming means for the microprocessors in the card, and a processing section microprocessor for carrying out a programmed manipulation procedure. The logo is loaded into the printer memory from the card memory by the terminal. However, the possibility of modifying the advertising logo exists only within limits, that is by loading in an externally modified advertising logo using new user cards.

German Published, Non-Prosecuted Application DE 37 12 100 A1 already discloses a postage meter message printing system in which the characters to be printed include a postage value and a remote-transmitted message. The electric postage meter is equipped with a postage meter calculation circuit that furnishes the postage value, a telephone or transmission connection, a message input device, a transmission control system, a printer, and a memory. The memory furnishes the message, and thus the characters to be printed are at least partly printed on the basis of data stored in the memory.

With the transmission control system connected between the transmission connection and the memory, the advertising logo can be modified selectively from the data center, if with the message input device a request is sent to the data center through the transmission connection, if the check of the encoded request has a positive outcome in the data center, and if the message forwarded by the data center has been checked in the postage meter. It has also already been proposed that a third party be given the option of printing advertising on his or her own mail, by renting out the space for the postage meter message. The message of a third party is then forwarded to the data center. The data center must send the message of the third part to the postage meter and likewise monitors the use of the message in the postage meter. However, that always requires provisions for assuring that the connection is maintained, that the message is authorized, and that the data are correct. No change in the message is possible without a check being performed in the data center. Since the memory is connected directly to the printer and stores the printing data for the message, the user is unable to check what printing data are currently stored in the memory. Nor can the postage meter user arbitrarily control the use of the thus-stored message.

As a rule, a postage meter produces an imprint in some form that is agreed upon with the postal service, that is flush at the right, beginning parallel to the upper edge of the mail and that contains the value of the postage, the date, the postmark, the advertising logo, and the class of mail. The postage value is the mail charge (postage) paid in advance by the sender. That charge is subtracted from a rechargeable account register and is used for franking the mail. The date is a current date or a future date in a postmark.

While the current date is automatically furnished by a time/date component, in the case of manual predating, an adjustment of the desired future date must be carried out. Predating is of interest whenever mail that has been generated must be handled and franked under strict deadlines, yet mailed on a certain date.

While the postage value, postmark, date and class of mail include the actual postal information, the approved advertising logos contain messages of the most varied kinds. From the postal standpoint, the advertising logo is an additional detail that must be agreed upon with the postal service. The advertising logo may include the address, the company logo, the post office box, and/or some arbitrary message.

However, any similarity, or an advertising logo simulated in some other way and altered in the process, also runs the risk of being mistaken for another or being manipulated. In the case of the imprint (the advertising logo), it has therefore already been proposed that certain concealed or cryptized characters, a bar code, or visible or invisible markings be applied to the mail, in order to enable the identification of counterfeits.

For example, German Published, Non-Prosecuted Application DE 40 03 006 A1 has proposed a method for identifying mail to enable identification of postage machines. A multi-place crypto number that includes the logo imprint data values stored in memory as a hexadecimal number, the machine parameters, the value setting, and the date and is intermediately or buffered-stored. Through the use of a printer control, the crypto number is additionally not inserted into the printed pattern or design until immediately prior to the printing. The printing pattern is likewise formed by the microprocessor-controlled printing process immediately prior to the printing, from fixed data and current data, and is available in buffer-stored form. Counterfeiting or any modification of the logo can thus be recognized from the crypto number.

A security system for use with a character printing authorization device is also known, from German Published, Non-Prosecuted Application DE 38 23 719 A1. A method for the graphics modification data and the data regarding the associated date that are to be loaded in is associated with a computer of the postage meter. If the user seeks a currency change, then access is gained by the computer of the postage meter to an external selector device through a connection device (modem), which performs a selection of a character pattern to be imprinted. Provision is made for the printed character pattern to be used to check the certainty of the postage meter authorization.

Heretofore, every message contained only the information agreed upon with the post office, or if a single message is allowed to be selected from among a plurality of messages, it contains a selection of agreed upon information. Any departure, on the other hand, leads to the identification of counterfeiting.

Unlike the defined specification of the postage value in the value imprint and unlike the data in the postmark, which can be specified automatically, it is an object of the invention to provide the modification of the logo through the actuating elements as an additional function in new postage meters, without requiring prior agreement from some data center or from the post office.

It is accordingly an object of the invention to provide an apparatus and a method for changing the text portion of logos for postage meters, which overcomes the hereinaforementioned disadvantages of the heretofore-known devices and methods of this general type, in which this change in the text portion on one hand does not lead to reduced security against counterfeiting yet on the other hand mail provided with this kind of logo text portion modification will not automatically be rejected in the post office as allegedly counterfeit in the course of checking the postage on mail in the post office.

In particular, such an apparatus should make it possible for a further message to be made in an agreed-upon window of a field for an advertising logo in the postage meter imprint, with the message addressing the addressee in clear characters. The intent is for an alphanumeric text portion that has not been agreed upon with the post office and which contains arbitrary information, such as dates on which a business will be closed for vacation, exhibitions, meetings, and/or public events, to be displayed in the agreed-upon window.

It is accordingly an object of the invention to provide an apparatus for changing the text portion of logos for postage meters, comprising a printer module for a fully electronically produced postage meter imprint having an advertising logo; at least one input means; a display unit; an input/output control module connected to the at least one input means and to the display unit; a nonvolatile memory for at least unchanging parts of the postage meter imprint; a control device connected to the input/output control module and to the nonvolatile memory; and a printer control connected to the control device and to the printer module for producing a printed pattern having been formed by a microprocessor-controlled printing process immediately prior to printing of fixed data and current data and being available in buffer-stored form; the nonvolatile memory having a first memory region for storing data for the unchanging parts of the postage meter imprint applying at least to a frame of an advertising logo, and an associated name identifying the logo frame; a second memory region for storing data for variable parts of the postage meter imprint applying to at least one logo text portion, and an associated name identifying the logo text portion; and a third memory region for storing data for a first association of the names of the logo text portions with the names of the logo frames.

The invention takes as its point of departure the fact that electronically embedding variable data in fixed frames for imprinting the postage value is known and that in the embedding of a variable text portion in a frame, the procedure is the same for an advertising logo, and at least one window is defined within the total representation of the advertising logo. In order to save memory space, only those parts of a graphical representation that are actually modified are stored when modification is carried out. The data of the window contents can be taken from the second memory region for the sake of composing a total representation of a postage meter imprint.

The composing is carried out similarly to the procedure for the date in the postmark and the postage value in the value imprint, in that the variable text portion in the window can be added to afterward and modified.

According to the invention, the apparatus for modifying the logo text portion for postage meters has a pixel memory with two separate memory regions. Besides the first memory region for the type of logo, a second memory region is provided for a plurality of associatable logo text portions, and this memory region communicates with a device that is capable of modifying the data in this second memory region. The data from both memory regions are composed to make a total representation of an advertising logo in accordance with a freely selectable association, before or during the printing.

Heretofore, any modification requested by the user was required to be authorized by the postal authorities. The invention is therefore further based on the concept of agreeing with the post office upon an approval method for logo types that can be partially added to by the customer, so that in the postage meter, through its keyboard, the function for changing alphanumeric text portions inside the advertising logo can be made possible. This obviates the necessity of requesting new advertising logos each time from the center, thereby also dispensing with the associated complicated and expensive security procedure, including the transmission of encoded signals.

With the objects of the invention in view, there is also provided a method for logo text portion modification for postage meters, which comprises loading agreed-upon logo types by modem or chip card and performing a selection of a logo type in a manner that is known per se, but according to the invention editing of a logo text portion in the postage meter and composition and display of a total representation, and optionally storage in memory of the edited text portion, takes place before the printing is done.

Other features which are considered as characteristic for the invention are set forth in the appended claims.

Although the invention is illustrated and described herein as embodied in an apparatus and a method for changing the text portion of logos for postage meters, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
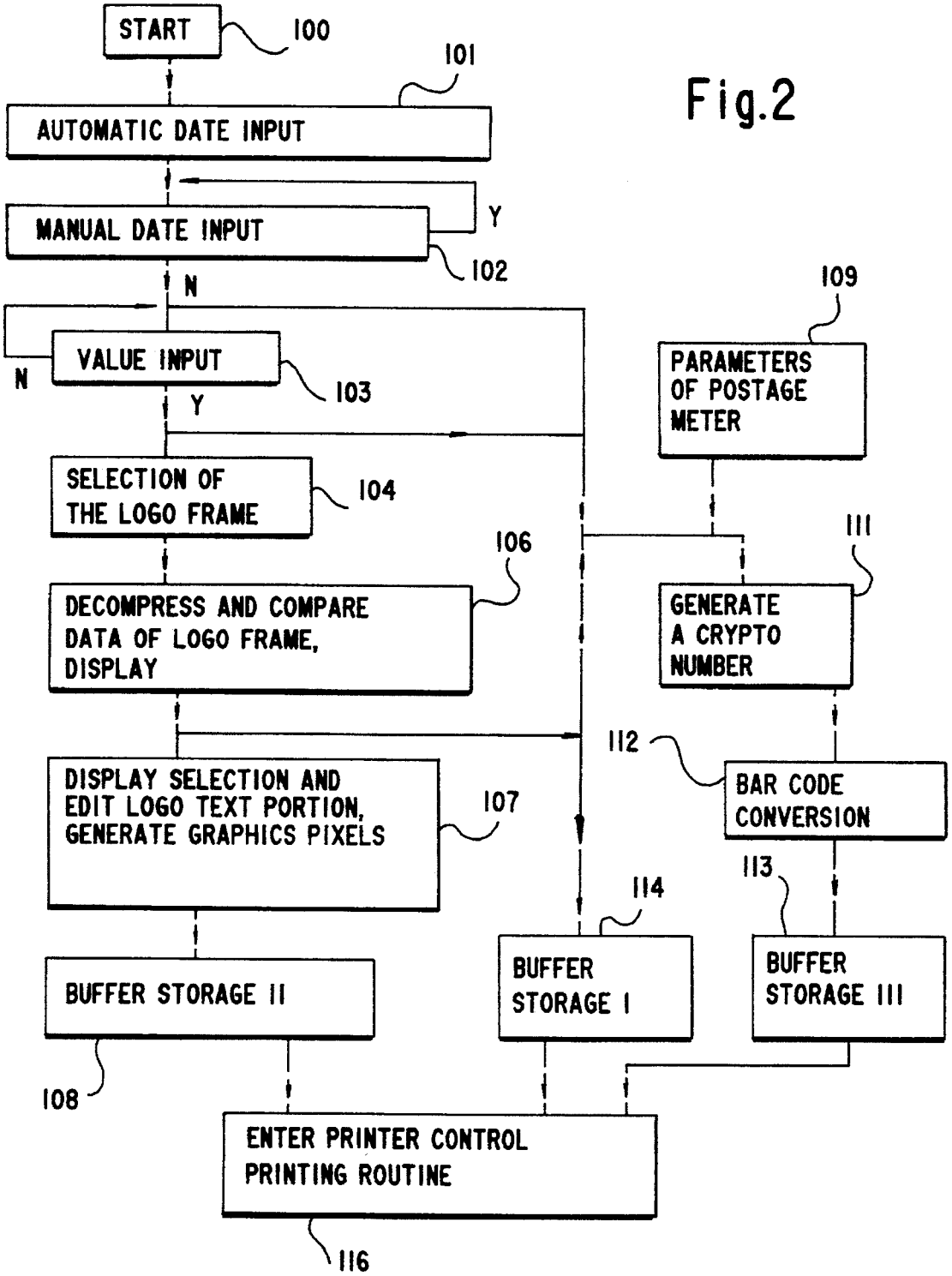

FIG. 1 is a block circuit diagram of a postage meter according to the invention; and FIG. 2 is a flow chart of a second variant of the postage meter according to the invention.

Referring now to the figures of the drawing in detail and first, particularly, to FIG. 1 thereof, there is seen a block circuit diagram of a postage meter or franking machine according to the invention, with a print head or printer module 1 for a fully electronically generated postage meter imprint that includes an advertising logo, at least one input means 2 which has actuating elements, and a display unit 3, an input/output control module 4 through which the input means 2 and the display unit 3 are coupled, a nonvolatile memory 5 for at least parts of the postage meter imprint which do not change, and a control device 6. A character memory 9 furnishes the necessary printing data for a pixel memory 7. The control device 6 has a microprocessor P, which is connected to the input/output control module 4, the character memory 9, the pixel memory 7, the nonvolatile or working memory 5, a cost location memory 10, a program memory 11, a transport or feed device 12 which optionally has strip tripping, an encoder (coding disk) 13, and a time/date component 8.

All of the alphanumeric characters are stored in pixels as binary data in the character memory 9, Data for alphanumeric characters are stored in the memory 5 in the form of a hexadecimal number. In accordance with a position report furnished by the encoder 13 upon the advancement of mail or a paper strip in relation to the print head or printer module 1, the data are read out of the working memory 5 and converted with the aid of the character memory 9 into a printing image, which is stored in the pixel memory 7.

The pixel memory 7 is connected to the print head 1 through a printer control 14 that has an output logic. On the output side, the pixel memory 7 is connected to a first input of the printer control 14, which has other control inputs at which output signals of the microprocessor control device 6 are present.

The method for changing the text portion of logos in postage meters is characterized by the following steps:

a) loading agreed-upon logo frames through a modem or chip card;

b) selection of a logo frame;

c) editing of a logo text portion in the postage meter; and d) composition and display of a total representation of the postage meter imprint, in which the edited text portion can be stored in memory prior to the application of the postage to the mail.

Provision is made for selection of a logo frame prior to the editing of a logo text portion in the postage meter for a representation of a number of names of logo frames, or a clear representation of the selection of the logo frames, with an associated logo or standard text portion from a working memory. An association of at least one of the variable text portions with each logo frame is made by acknowledgement of the selection. Through the use of the actuating elements, editing of the selected logo text portion can be carried out with simultaneous clear-character display in the display unit. After the editing of a logo text portion and the composition and display of a total representation of a postage meter imprint, storage in memory of the edited text portion takes place automatically before the postage is applied to the mail, in which a new name and a new association of the edited text portion with the logo frame is stored in memory in memory regions B and C.

At least one window within the total representation of the advertising logo imprint is defined so that in the separate memory region B only the parts of a graphical representation that actually are modified are stored in memory upon a modification. The data of the window contents can be extracted again from the memory region B in order to compose a complete representation of a postage meter imprint. At least in one region of the memory 5, run length encoding of graphical data has been provided in which the first code of each line of the encoding indicates the number of pixels to be printed per column, and control codes are available in the hexadecimal display, for instance for the beginning of a window, the end of a column, and the end of an image.

The apparatus for logo text portion modification for postage meters has a first memory region A in the memory 5 and a memory region I in the pixel memory 7 for the data of the unchanging parts of the postage meter imprint (advertising logo frame), wherein an associated name identifies the logo frame, and a second memory region B and a memory region II in the pixel memory 7 for the data of the variable parts of the postage meter imprint (logo text portion), in which an associated name identifies the logo text portion. The data for a first association of the names of the logo text portions with the names of the logo frames are available in a third memory region C.

The logo frame data and the data for the variable logo text portions are extracted as needed from the memory regions A and B, taking the association into account. Since the selectable logo frames are each associated with a cost location in the cost location memory 10, and/or a second association of logo types with cost locations is available and stored in a fourth memory region D, the assembling of printed image data can be performed by the control device 6.

Provision is made for the names of the logo frames, which are stored in the first memory region A, to be assembled from the number of the cost location K and a type number T, for the names of the logo text portions which are stored in a second memory region B to be determined by the current data at the moment of generation and optionally by the time U, and for the data for the first association in the third memory region C to be determined by storage in memory of both the name of the logo frame, containing the cost location number K and the type number T, and the name of the logo text portion, containing a date D and optionally a time U.

Provision is also made to ensure that the representation required for a logo selection is effected in the display unit 3 only of names of those logo frames for which associations occurring in a defined period of time exist in the third memory region C. A logo frame without an existing association of a name with a logo text portion name cannot be displayed with it. The association may, for instance, relate to the period of time of the current year. Once the name has been selected and acknowledged, the associated logo frame is shown in a clear representation.

The representation of the names of logo text portions is performed in windows that are intended for this purpose and are part of the particular field of the display unit 3 in which the clear representation of the logo frame is also visible.

In the case of another variant of the representation, for the sake of better selection of logo text portions, the clear representations of the logo text portions should appear in the window of the field of the display unit in an order determined by the time data of the name.

In a preferred variant, the defined time period is automatically defined by the selectable time data in the data of the association of logo text portions, particularly such time data as that pertaining to the month and/or the year, in relation to the current date furnished by the time/date component 8.

In another advantageous version of the concept of the invention, an association exists in a fifth memory region E, which pertains to a freely programmable defined period of time in which the time data in the data of the associations of logo text portions with logo frames are in relation to the current date.

FIG. 2 is a flow chart illustrating a second variant of the device according to the invention. In this case it is possible in addition, for identification purposes, to use especially generated, enciphered marking data stored in a sixth memory region F. The apparatus for logo text portion modification for postage meters then has three separate memory regions in the pixel memory. Besides the first memory region I for the data regarding the logo type and the second memory region II for a plurality of associatable logo text portion data, a third memory region III for the marking data is provided, which is connected to a device that is capable of changing the data in these second and third memory regions. The data from the three memory regions are assembled during printing, in accordance with an association that is freely selectable within certain limits, to make a total representation of an advertising logo.

In particular, in a modification of the version shown in German Published, Non-Prosecuted Application DE 40 03 006 A1, an identification of mail can be made by means of a crypto number, imprinted in the logo as a bar code, to enable identification of postage meters without difficulty, if the multiple-place crypto number is formed and buffer-stored without including the data values, which are stored as a hexadecimal number, of the total logo, but instead only including the data values of the logo frame and other data, such as the postage meter parameters, the value setting and the date.

In the flow chart according to FIG. 2 after a start 100, the date is entered in a step 101 if the date is to be entered automatically, or in a step 102 if the date is to be entered manually. If the date is entered manually, the step 102 provides for a waiting time required for manual entry. Next, in a step 103, the franking value is entered. In a step 104, a logo frame is selected as described above, and in a subsequent step 106, the logo frame data are decompressed, formatted and prepared for display. In a step 107, the selected frame data are displayed, the logo text portion is edited, and the graphics pixels are generated, and in a step 108, the generated data are temporarily stored in a buffer store II. In a step 116, the data stored in the buffer store II are entered into the printer control, and printing of stored data is performed. In case the step 103, or the steps 104 and 106, or the steps 107 and 108 are not required, the data input from the steps 101 or 102 go directly to a buffer storage I, and from there they can be directly entered into the printer control for printing, as is shown in steps 114 and 116.

Alternatively, if the parameters of the postage meter are to be encrypted, the parameters of the postage meter are entered in a step 109, following any one of the steps 102, 103 or 106. Next, a crypto number in a step 111 is generated as described above and the crypto number is converted to a bar code in a step. 112. Next, the bar code data are entered in a buffer storage III to be entered in the printer control and printed in the step 116.

The invention is not limited to the embodiment shown. Instead, a number of variants that make use of the version as shown, even in fundamentally different types of embodiments, are conceivable.

We claim:

1. An apparatus for changing the text portion of logos for postage meters, comprising:

a printer module for a fully electronically produced postage meter imprint having an advertising logo;

at least one input means;

a display unit;

an input/output control module connected to said at least one input means and to said display unit;

a nonvolatile memory for at least unchanging parts of the postage meter imprint;

a control device connected to said input/output control module and to said nonvolatile memory; and a printer control connected to said control device and to said printer module for producing a printed pattern having been formed by a microprocessor-controlled printing process immediately prior to printing of fixed data and current data and being available in buffer-stored form;

said nonvolatile memory having:

a first memory region for storing data for the unchanging parts of the postage meter imprint applying at least to a frame of an advertising logo, and an associated name identifying the logo frame;

a second memory region for storing data for variable parts of the postage meter imprint applying to at least one logo text portion, and an associated name identifying the logo text portion; and a third memory region for storing data for a first association of the names of the logo text portions with the names of the logo frames.

2. The apparatus according to claim 1, wherein said nonvolatile memory has a fourth memory region for storing at least one of a cost location associated with each selected logo frame and a second association of logo types with cost locations.

3. The apparatus according to claim 1, wherein the names of the logo frames stored in said first memory region are composed of the number of the cost location and a type number;

the names of the logo text portions stored in said second memory region are determined by the current date; and the dates for the first association in said third memory region are determined by storing in memory both the name of the logo frame containing the cost location number and the type number and the name of the logo text portion containing the current date.

4. The apparatus according to claim 3, wherein the names of the logo text portions stored in said second memory region are determined by the current date and by the time; and the dates for the first association in said third memory region are determined by storing in memory both the name of the logo frame containing the cost location number and the type number and the name of the logo text portion containing the current date and the time.

5. The apparatus according to claim 1, wherein said display unit displays only names of those logo frames for which associations occurring in a defined period of time exist in said third memory region.

6. The apparatus according to claim 5, wherein the defined period of time results automatically from the components of the name of the association of logo text portions.

7. The apparatus according to claim 6, wherein the defined period of time results automatically from the components of the name of the association of at least one of the month and the year, in relation to the current date.

8. The apparatus according to claim 1, wherein said display unit has a field with a display window for the names of the logo text portions in which a clear representation is made after the selection.

9. The apparatus according to claim 1, wherein said display unit has a field with a display window for the names of the logo text portions in which a clear representations appears for selection in an order determined by time-related components of the name.

10. The apparatus according to claim 6, wherein said nonvolatile memory has a fourth memory region for storing at least one of a cost location associated with each selected logo frame and a second association of logo types with cost locations, and said nonvolatile memory has a fifth memory region for storing an association relating to a freely programmable, defined period of time in which the names of the associations of the logo text portions with the logo frames are in relation to the current date.

11. The apparatus according to claim 7, wherein said nonvolatile memory has a fourth memory region for storing at least one of a cost location associated with each selected logo frame and a second association of logo types with cost locations, and said nonvolatile memory has a fifth memory region for storing an association relating to a freely programmable, defined period of time in which the names of the associations of the logo text portions with the logo frames are in relation to the current date.

* * * * *